US009430984B2

(12) United States Patent
Meng

(10) Patent No.: US 9,430,984 B2
(45) Date of Patent: Aug. 30, 2016

(54) DISPLAY PANEL DRIVING CIRCUIT, DRIVING METHOD THEREOF, AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Zhaohui Meng, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 20 days.

(21) Appl. No.: 14/498,345

(22) Filed: Sep. 26, 2014

(65) Prior Publication Data

US 2015/0294637 A1 Oct. 15, 2015

(30) Foreign Application Priority Data

Apr. 15, 2014 (CN) ..... 2014 1 0150397

(51) Int. Cl.
*G09G 3/36* (2006.01)

(52) U.S. Cl.
CPC .... *G09G 3/3688* (2013.01); *G09G 2310/0251* (2013.01)

(58) Field of Classification Search
CPC ..... G09G 3/3648; G09G 3/3696; G09G 2300/08; G09G 2300/0404; G09G 2300/0478; G09G 2310/0264; G09G 2310/0291
See application file for complete search history.

(56) References Cited

U.S. PATENT DOCUMENTS 6,008,801 A * 12/1999 Jeong ..... G09G 3/3688 345/100
6,744,415 B2 * 6/2004 Waterman ..... G09G 3/2011 345/100

(Continued)

FOREIGN PATENT DOCUMENTS

CN 1427385 A 7/2003
CN 101014988 A 8/2007

(Continued)

OTHER PUBLICATIONS

1st Office Action issued in Chinese application No. 201410150397.2 dated Aug. 4, 2015.

(Continued)

*Primary Examiner* — Viet Pham
(74) *Attorney, Agent, or Firm* — Nath, Goldberg & Meyer; Joshua B. Goldberg; Christopher Thomas

(57) ABSTRACT

Embodiments of the present invention provide a driving circuit for a display panel which comprises a plurality of pixel units defined by intersected gate lines and data lines and arranged in a matrix form, a driving method of a display panel driving circuit and a display device, relating to the field of display technology. The display panel driving circuit includes pixel charging units, each of which is used for combining voltages outputted from a clock pulse vertical terminal and a data voltage signal terminal to serve as a driving voltage for a data line to increase the charging voltage of pixel units, so that the charging time is shortened, and the capability of driving a display panel load can be enhanced.

12 Claims, 4 Drawing Sheets

(56) References Cited

U.S. PATENT DOCUMENTS

| | | | | |
|---|---|---|---|---|
| 2002/0075219 | A1 | 6/2002 | Morita | |
| 2006/0197733 | A1* | 9/2006 | Lee | G09G 3/3648 345/100 |
| 2009/0167739 | A1* | 7/2009 | Tsubata | G09G 3/3659 345/208 |
| 2012/0299903 | A1* | 11/2012 | Lim | G09G 3/3688 345/212 |
| 2015/0194086 | A1* | 7/2015 | Kim | G09G 3/3688 345/214 |

FOREIGN PATENT DOCUMENTS

| | | | |
|---|---|---|---|
| CN | 100456351 | C | 1/2009 |
| JP | 2007248536 | A | 9/2007 |
| KR | 101254991 | B1 | 4/2013 |

OTHER PUBLICATIONS

Notification of the Third Office Action dated May 30, 2016 corresponding to Chinese application No. 201410150397.2.

* cited by examiner

-- PRIOR ART --

DISPLAY PANEL DRIVING CIRCUIT, DRIVING METHOD THEREOF, AND DISPLAY DEVICE

FIELD OF THE INVENTION

The present invention relates to the field of display technology, and particularly relates to a display panel driving circuit, a driving method thereof, and a display device.

BACKGROUND OF THE INVENTION

A TFT-LCD (Thin Film Transistor Liquid Crystal Display) is a flat panel display device and has the characteristics of small size, low power consumption, no radiation, relatively low manufacturing cost and the like, so that it is increasingly applied in the field of high-performance display.

In the prior art, a structure of the TFT-LCD is generally as shown in FIG. 1 and includes a display panel 10 and a driving unit comprising a timing controller (hereinafter referred to as "T/CON") 100, a gate driver 101 and a source driver 102. Specifically, under the control of the timing controller 100, the gate driver 101 controls signal outputs of gate lines (G1 . . . Gn) to sequentially turn on the thin film transistors, which are connected to respective gate lines, line by line; and the source driver 102 controls signal outputs of data lines (S1 . . . Sn) to display different pictures on the display panel 10, the gate lines and the data lines are intersected with each other to define a plurality of pixel units arranged in a matrix form.

In this case, in the control time sequence outputted by the timing controller 100, the turn-on and turn-off of gates of each row are controlled by a clock pulse vertical (hereinafter referred to as "CPV"). The specific control process is as follows: transmitting a start vertical (hereinafter referred to as "STV") signal which is a high level signal indicating that gates may be turned on. Then when the CPV is at a rising edge, the gates of TFTs (Thin Film Transistor) of the first row are turned on, and a data signal, by the source driver 102, is loaded to storage capacitors $CS_1$ at two terminals of the TFTs of the first row via the sources of the TFTs, and the TFTs of the first row start to charge; and when the next rising edge of the CPV arrives, the gates of TFTs of the first row are turned off, loading of the corresponding data signal is completed, charging of the TFTs of the first row is completed, meanwhile, the gates of the TFTs of the second row are turned on, a data signal is loaded to storage capacitors $CS_2$ at two terminals of the TFTs of the second row via the sources of the TFTs, and the TFTs of the following rows act as the same way.

With the development of display technology, a TFT-LCD display panel is required to have increasingly large screen size and increasingly high resolution and PPI (Pixels Per Inch). However, when the capability of driving a liquid crystal load is insufficient, pixel units cannot be charged within a short period of time, so that the LCD cannot meet the requirements of high resolution and high PPI, and thus the performance and quality of a product are decreased.

SUMMARY OF THE INVENTION

An object of the present invention is to provide a display panel driving circuit, a driving method thereof and a display device, which can increase the charging voltage of pixel units, so that the charging time can be shortened and the capability of driving a display panel load can be enhanced.

To achieve the above-mentioned object, the embodiments of the present invention adopt technical solutions as below.

An aspect of the embodiments of the present invention provides a driving circuit for a display panel which comprises a plurality of pixel units defined by intersected gate lines and data lines and arranged in a matrix form. The driving circuit includes a pixel charging unit for combining voltages outputted from a clock pulse vertical terminal and a data voltage signal terminal to serve as a driving voltage for a data line.

Another aspect of the embodiments of the present invention provides a display device, including the above-mentioned display panel driving circuit.

Still another aspect of the embodiments of the present invention provides a driving method of a driving circuit for a display panel which comprises a plurality of pixel units defined by intersected gate lines and data lines and arranged in a matrix form, and the driving method includes steps of:

inputting voltage signals outputted from a clock pulse vertical terminal and a data voltage signal terminal to a pixel charging unit; and combining, by the pixel charging unit, voltages outputted from the clock pulse vertical terminal and the data voltage signal terminal to serve as a driving voltage for a data line.

BRIEF DESCRIPTION OF THE DRAWINGS

To illustrate technical solutions in the embodiments of the present invention or in the prior art more clearly, a brief introduction on the accompanying drawings which are required in the description of the embodiments or the prior art is given below. Apparently, the accompanying drawings in the description below are merely some of the embodiments of the present invention, based on which other drawings may be obtained by the person skilled in the art without creative effort.

DETAILED DESCRIPTION OF THE EMBODIMENTS

Technical solutions in the embodiments of the present invention will be clearly and completely described below, in combination with the accompanying drawings in the embodiments of the present invention. Apparently, the embodiments described are merely a part but not all of the embodiments of the present invention. All other embodiments which, based on the embodiments of the present invention, are obtained by the person skilled in the art without inventive efforts are within the protection scope of the present invention.

Figure 2:
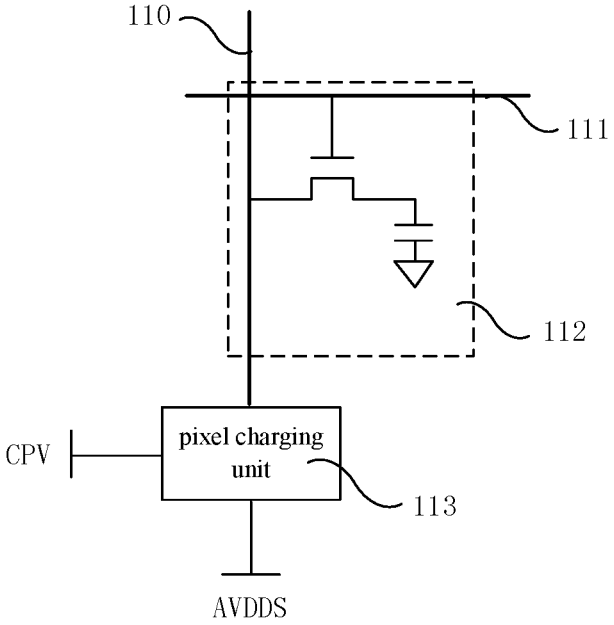
FIG. 2 is a schematic diagram of a structure of a display panel driving circuit according to an embodiment of the present invention.

FIG. 2 is a schematic diagram of a driving circuit for a display panel which comprises gate lines 111 and data lines 110 according to an embodiment of the present invention. Here, the gate lines 111 and the data lines 110 are intersected with each other to define a plurality of pixel units 112 arranged in a matrix form. The display panel driving circuit may include pixel charging units 113, each of which is used for combining a voltage outputted from a clock pulse vertical terminal (CPV) and a voltage outputted from a data voltage signal terminal (AVDDS) to serve as a driving voltage for a data line 110.

Figure 1:
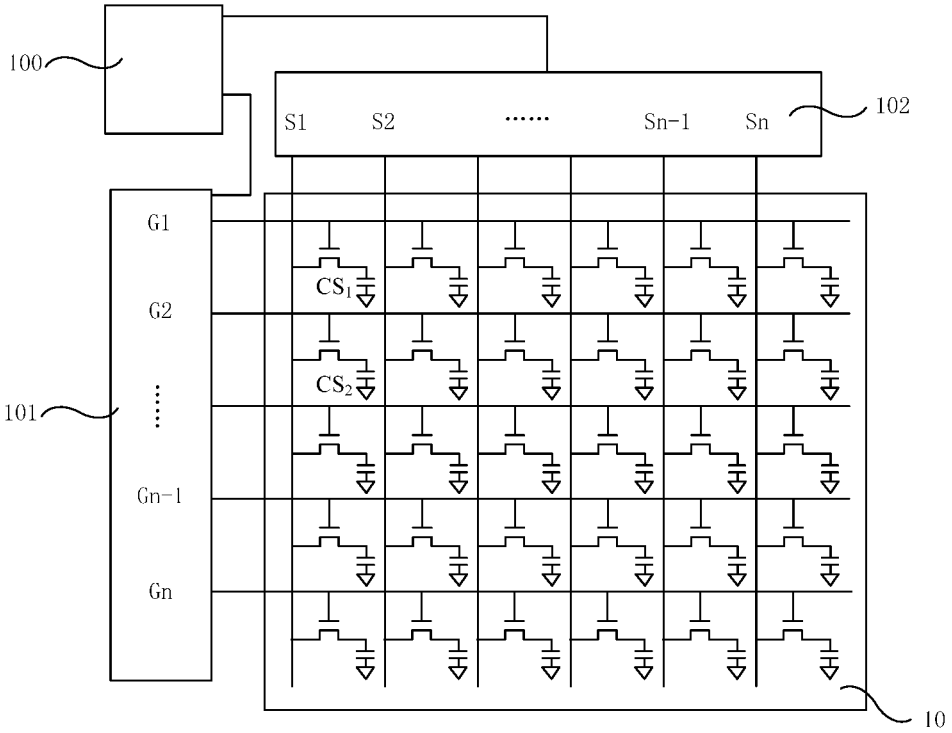
FIG. 1 is a schematic diagram of a structure of a display device according to the prior art.

It should be noted that, turning on the TFTs of each row requires a signal in which the turn-on time is long enough, and the signal is useless after the TFTs are turned on, and therefore, the signal outputted from the clock pulse vertical terminal may be preferably adopted. Other existing signals in the display panel driving circuit such as a gate driving circuit start vertical may also be used, but the STV signal needs to be lengthened, and the length of the CPV signal may maintain unchanged. In addition, the above-mentioned pixel charging unit 113 may be provided on the display panel 10 or on a D-IC (Driver-Integrated circuit) for driving the display panel to display. For example, the pixel charging unit 113 may be provided on the source driver 102 as shown in FIG. 1. The above description of the setting positions of the pixel charging unit 113 is merely given as an exemplarily example for illustrating, but the present invention is not limited thereto; the pixel charging unit 113 may also be provided at other positions, which should belong to the protection scope of the present invention.

Each of the pixel charging units 113 according to the embodiment of the present invention may combine a voltage outputted from the clock pulse vertical terminal and a voltage outputted from the data voltage signal terminal to serve as the driving voltage for a data line. Therefore, an auxiliary charging voltage outputted from the clock pulse vertical terminal may improve the charging voltage of pixel units, so that the charging time may be shortened, and the capability of driving a display panel load can be enhanced.

Optionally, each data line 110 is connected with one pixel charging unit 113. That is, the pixel charging unit 113 may independently provide a driving voltage for each data line 110, which facilitates independent driving control of each data line 110. Thus, the pixel units defined by the data line of this column may be quickly charged under the action of the auxiliary charging voltage outputted from the clock pulse vertical terminal, so that the charging time of liquid crystal may be shortened.

Figure 3:
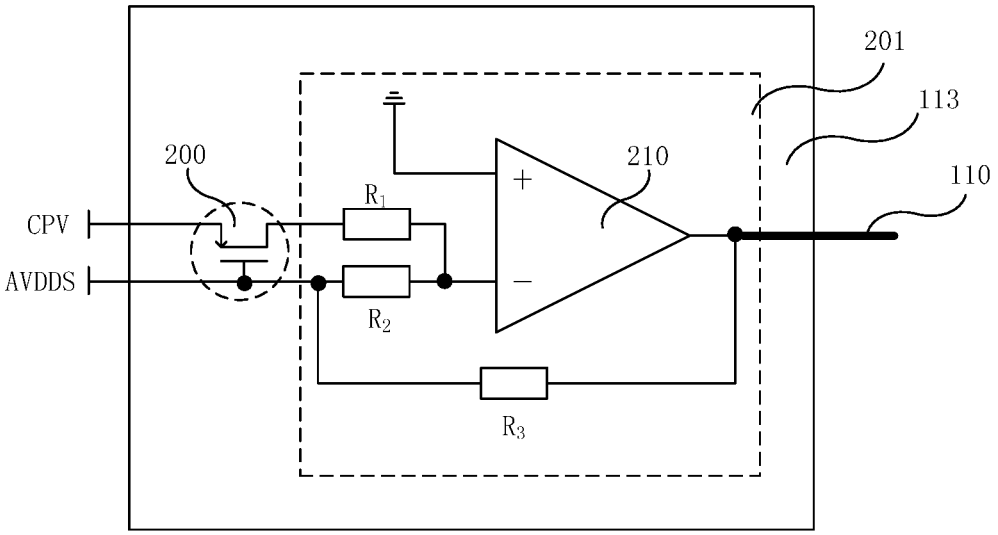
FIG. 3 is a schematic diagram of a structure of another display panel driving circuit according to an embodiment of the present invention.

Optionally, as shown in FIG. 3, the pixel charging unit 113 may include a pixel charging switch 200 and an adder 201.

The first electrode of the pixel charging switch 200 is connected with a clock pulse vertical terminal; and the gate of the pixel charging switch 200 is connected with a data voltage signal terminal.

The input terminal of the adder 201 is connected with the data voltage signal terminal and the second electrode of the pixel charging switch 200, respectively; and the output terminal of the adder 201 is connected with a data line 110.

While a data voltage signal is outputted from the data voltage signal terminal to the adder 201, the pixel charging switch 200 may be turned on, so that a clock pulse vertical outputted from the clock pulse vertical terminal may be inputted to the adder 201 as an auxiliary charging voltage. Under the action of the adder 201, the voltage outputted from the clock pulse vertical terminal and the voltage outputted from the data voltage signal terminal are added to serve as a driving voltage for the data line 110, so that the charging voltage of the pixel unit 112 is increased.

Optionally, the above-mentioned adder 201 includes a first resistor R1, a second resistor R2, a third resistor R3 and a first operational amplifier 210.

One terminal of the first resistor R1 is connected with the second electrode of the pixel charging switch 200, and the other terminal of the first resistor is connected with the inverting input terminal of the first operational amplifier 210.

One terminal of the second resistor R2 is connected with the data voltage signal terminal, and the other terminal of the second resistor is connected with the inverting input terminal of the first operational amplifier 210.

One terminal of the third resistor R3 is connected with the data voltage signal terminal, and the other terminal of the third resistor is connected with the output terminal of the first operational amplifier 210.

The non-inverting input terminal of the first operational amplifier 210 is grounded.

Figure 4:
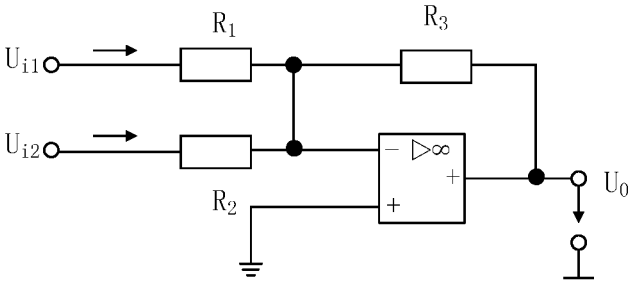
FIG. 4 is a schematic diagram illustrating working principle of an adder according to an embodiment of the present invention.

Specifically, the working principle of the adder 201 may be as shown in FIG. 4, and it could be obtained that:

$$\frac{U_{i1}}{R_1} + \frac{U_{i2}}{R_2} = -\frac{U_0}{R_3}$$

it could be further obtained that, $$U_0 = -R_3\left(\frac{U_{i1}}{R_1} + \frac{U_{i2}}{R_2}\right)$$

wherein $U_{i1}$ may be the voltage outputted from the clock pulse vertical terminal, and $U_{i2}$ may be the voltage outputted from the data voltage signal terminal. When $R_3=R_1=R_2$, the voltage provided from the adder 201 to the data line 110 is $U_0=-(U_{i1}+U_{i2})$. It should be noted that, the above-mentioned adder is an inverting adder.

Figure 5:
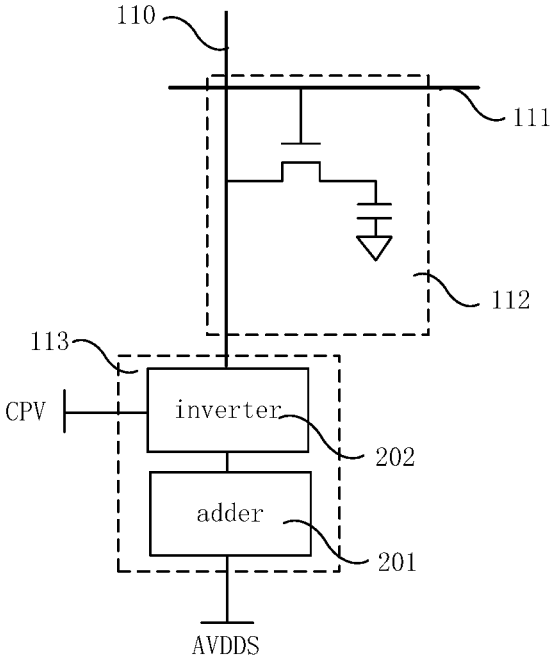
FIG. 5 is a schematic diagram of a structure of a still another display panel driving circuit according to an embodiment of the present invention.

Optionally, when the adder 201 is an inverting adder, as shown in FIG. 5, the above-mentioned pixel charging unit 113 may further include an inverter 202.

The inverter 202 is connected with the adder 201 and the data line 110, respectively, and is configured to inverse the polarity of the voltage signal outputted by the adder 201.

Figure 6:
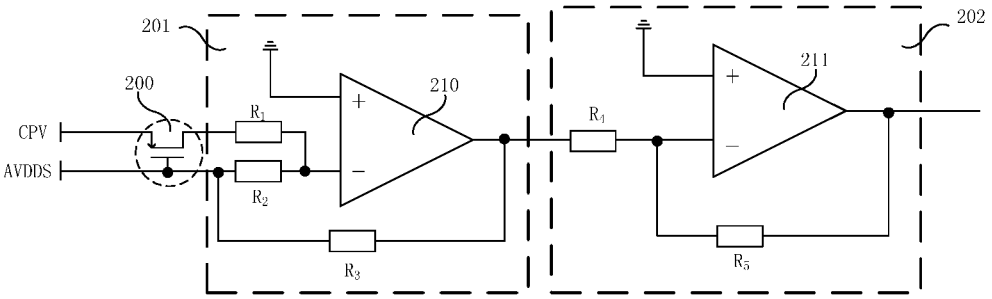
FIG. 6 is a schematic diagram of a structure of still another display panel driving circuit according to an embodiment of the present invention.

Optionally, as shown in FIG. 6, the above-mentioned inverter 202 includes a fourth resistor $R_4$, a fifth resistor $R_5$ and a second operational amplifier 211.

One terminal of the fourth resistor $R_4$ is connected with the output terminal of the first operational amplifier 210, and the other terminal of the fourth resistor is connected with the inverting input terminal of the second operational amplifier 211.

One terminal of the fifth resistor $R_5$ is connected with the inverting input terminal of the second operational amplifier 211, and the other terminal of the fifth resistor is connected with the output terminal of the second operational amplifier 211.

The non-inverting input terminal of the second operational amplifier 211 is grounded.

Figure 7:
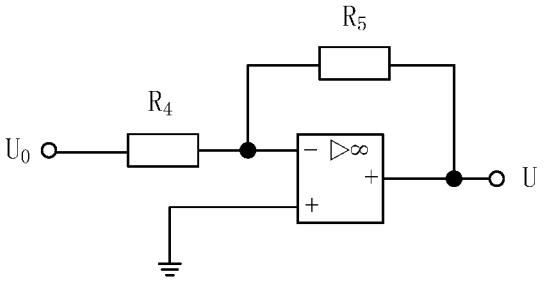
FIG. 7 is a schematic diagram illustrating working principle of an inverter according to an embodiment of the present invention.

Specifically, the working principle of the inverter 202 may be as shown in FIG. 7, and it could be obtained that:

$$\frac{U_0}{R_4} = -\frac{U}{R_5}$$

when $R_4=R_5$, $U=-U_0$;

accordingly, $U=-(-(U_{i1}+U_{i2}))=U_{i1}+U_{i2}$.

Therefore, when the polarity of a voltage signal output by the adder 201 is negative, the polarity of the voltage signal provided to the data line 110 may be changed to be positive by the inverter 202. Thus, the polarity may be consistent with the conventional polarity of the voltage signal transmitted on the data line in the existing display control timing diagram, so as to facilitate drawing and analyzing the above-mentioned timing diagram by the person skilled in the art. Of course, when the polarity of a voltage signal outputted from the adder 201 is positive, the polarity of the voltage signal provided to the data line 110 may be changed to be negative by the inverter 202. Thus, different requirements for the polarity of the voltage signals on the data lines may be met.

Optionally, the above-mentioned voltage outputted from the clock pulse vertical terminal (i.e., $U_{i1}$) may be 3.3V.

It should be noted that, for each data line 110 on the display panel 10, a gamma value needs to be adjusted at the initial stage of display, and a voltage of 3.3V (the above-mentioned voltage outputted from the clock pulse vertical terminal) may be additionally applied to the data line 110, but the voltage is applied for a very short time, and therefore, the previous data only needs to be slightly adjusted when adjusting the gamma value. So the above-mentioned voltage of 3.3V outputted from the clock pulse vertical terminal may also be used for gamma adjustment. Of course, the above description only illustrates an example of the amplitude of the voltage outputted from the clock pulse vertical terminal, and voltages of other amplitudes are not listed one by one herein but should belong to the protection scope of the present invention.

Optionally, the above-mentioned voltage outputted from the data voltage signal terminal (i.e., $U_{i2}$) is 6-10V.

Figure 8:
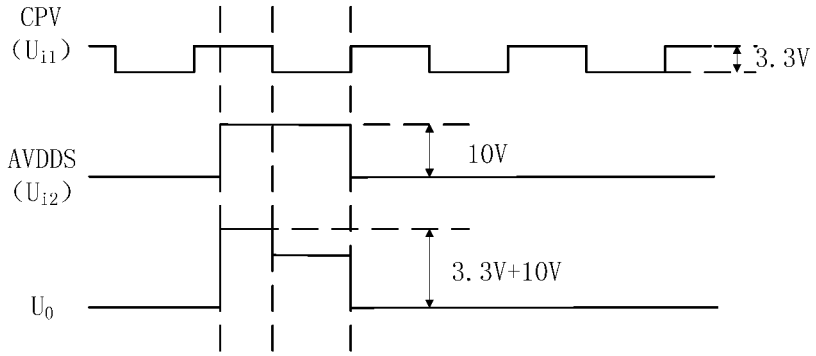
FIG. 8 is a timing diagram of a display panel driving circuit according to an embodiment of the present invention.

Specifically, as shown in FIG. 8, when the voltage outputted from the clock pulse vertical terminal (i.e., $U_{i1}$) is 3.3V and the voltage outputted from the data voltage signal terminal (i.e., $U_{i2}$) is 10V, the two voltages are added by the adder 201, so that the voltage (i.e., $U_0$) provided to the data line 110 is 3.3V+10V.

Figure 9:
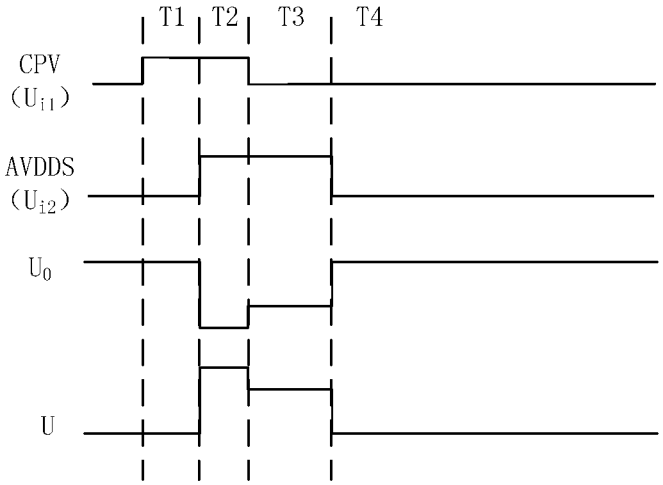
FIG. 9 is a timing diagram of another display panel driving circuit according to an embodiment of the present invention.

The working process of the pixel charging unit 200 will be described in detail below in combination with FIGS. 6 and 9.

At a T1 stage, a voltage of about 3.3V is outputted from the clock pulse vertical terminal before a voltage signal is outputted from the data voltage signal terminal. At this point, the pixel charging switch 200 is off since no signal is outputted from the data voltage signal terminal. Therefore, the pixel charging unit 113 cannot charge the display panel 10 at the T1 stage.

At a T2 stage, a voltage signal is outputted from the data voltage signal terminal under the control of the D-IC to charge the display panel 10. At this point, the pixel charging switch 200 is turned on accordingly, and both the voltage (i.e., $U_{i1}$) outputted from the clock pulse vertical terminal and the voltage (i.e., $U_{i2}$) outputted from the data voltage signal terminal are inputted to the adder 201. The voltage outputted from the adder 201 is $U_0=-(U_{i1}+U_{i2})$, and its polarity is negative. After the voltage $U_0$ is processed by the inverter 202, the voltage on the data line 110 is $U=U_{i1}+U_{i2}$, and its polarity is positive.

At a T3 stage, clock pulse vertical terminal stops outputting the voltage signal, and then the auxiliary charging process for increasing the charging voltage is terminated. At this point, the voltage outputted from the adder 201 is the voltage outputted from the data voltage signal terminal, i.e., $U_0=-U_{i2}$, and its polarity is negative. After the voltage $U_0$ is processed by the inverter 202, the voltage on the data line 110 is $U=U_{i2}$, and its polarity is positive.

At a T4 stage, data voltage signal terminal stops outputting the voltage signal, and the charging process is terminated.

With the above steps, the voltage outputted from the clock pulse vertical terminal assists in charging the display panel 10, so that the driving capacity of the D-IC is improved, and the charging time of each pixel unit is shortened. Thus, the display device may meet the requirements for high PPI and high resolution.

A display device according to an embodiment of the present invention includes the above-mentioned display panel driving circuit. The display device achieves the same beneficial effects as the display panel driving circuit according to the aforementioned embodiment of the present invention. Because the display panel driving circuit has been described in detail in the aforementioned embodiment, it will not be repeated herein.

It should be noted that, in the embodiment of the present invention, specifically, the display device may include a liquid crystal display device, for example, the display device may be any product or component with a display function, such as a liquid crystal display, a liquid crystal television, a digital photo frame, a mobile phone, a tablet computer or the like.

Figure 10:
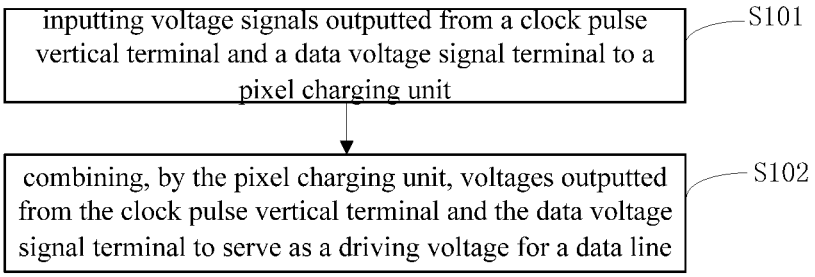
FIG. 10 is a flow chart of a driving method of a display panel driving circuit according to an embodiment of the present invention.

As shown in FIG. 10, a driving method of the display device driving circuit is provided, wherein the display device comprises a plurality of pixel units 200 defined by intersected gate lines 111 and data lines 110 and arranged in a matrix form, and the driving method comprises steps of:

S101, inputting voltage signals outputted from a clock pulse vertical terminal and a data voltage signal terminal to a pixel charging unit 113; and S102, combining, by the pixel charging unit, voltages outputted from the clock pulse vertical terminal and the data voltage signal terminal to serve as a driving voltage for a data line 110.

Optionally, the above-mentioned driving method of the display device driving circuit may further comprise a step of:

when a pixel charging switch 200 is turned on, combining, by an adder 201, the voltages outputted from the clock pulse vertical terminal and the data voltage signal terminal to serve as the driving voltage for the data line 110.

When a data voltage signal is outputted from the data voltage signal terminal to the adder 201, the pixel charging switch 200 may be turned on, so that a clock pulse vertical signal outputted from the clock pulse vertical terminal is inputted to the adder 201 as an auxiliary charging voltage. Under the action of the adder 201, the voltages outputted from the clock pulse vertical terminal and the data voltage signal terminal are added to serve as the driving voltage for the data line 110, so that the charging voltage of the pixel unit 112 is increased.

Optionally, the above-mentioned driving method of the display device driving circuit may further include a step of:

inversing the polarity of the voltage signal output by the adder 201 by an inverter 202. In this way, when the polarity of a voltage signal output by the adder 201 is negative, the polarity of the voltage signal provided to the data line 110 may be changed to be positive by the inverter 202. Thus, the polarity may be consistent with the conventional polarity of the voltage signal transmitted on the data line in the existing display control timing diagram, thus facilitating drawing and analyzing above-mentioned timing diagram by the person skilled in the art. Of course, when the polarity of a voltage signal output by the adder 201 is positive, the polarity of the voltage signal provided to the data line 110 may be changed to be negative by the inverter 202. Thus, different requirements for the polarity of the voltage signal on the data line can be met.

The foregoing descriptions are merely specific embodiments of the present invention, but the protection scope of the present invention is not limited thereto. Any skilled one familiar with this art of variations or substitutions that could readily conceived by the person skilled in the art within the disclosed technical scope of the present invention shall be covered by the protection scope of the present invention. Accordingly, the protection scope of the present invention should be subject to the protection scope of the claims.

The invention claimed is:

1. A display panel driving circuit, wherein the display panel comprises a plurality of pixel units defined by intersected gate lines and data lines and arranged in a matrix form, and the display device driving circuit comprises pixel charging units, each of which is used for combining a voltage outputted from a clock pulse vertical terminal and a voltage outputted from a data voltage signal terminal to serve as a driving voltage for a data line;

wherein each of the pixel charging units comprises:

a pixel charging switch with a first electrode connected with the clock pulse vertical terminal and a gate connected with the data voltage signal terminal; and an adder with an input terminal connected with the data voltage signal terminal and a second electrode of the pixel charging switch respectively, and an output terminal connected with the data line.

2. The display panel driving circuit according to claim 1, wherein each of the data lines is connected with one pixel charging unit.

3. The display device driving circuit according to claim 1, wherein the adder comprises:

a first operational amplifier with a grounded non-inverting input terminal;

a first resistor with one terminal connected with the second electrode of the pixel charging switch and the other terminal connected with an inverting input terminal of the first operational amplifier;

a second resistor with one terminal connected with the data voltage signal terminal and the other terminal connected with the inverting input terminal of the first operational amplifier; and a third resistor with one terminal connected with the data voltage signal terminal and the other terminal connected with an output terminal of the first operational amplifier.

4. The display panel driving circuit according to claim 3, wherein when the adder is an inverting adder, the pixel charging unit further comprises:

an inverter, which is connected between the adder and the data line to change a polarity of a voltage signal output by the adder.

5. The display panel driving circuit according to claim 4, wherein the inverter comprises:

a second operational amplifier with a grounded non-inverting input terminal;

a fourth resistor with one terminal connected with the output terminal of the first operational amplifier and the other terminal connected with an inverting input terminal of the second operational amplifier; and a fifth resistor with one terminal connected with the inverting input terminal of the second operational amplifier and the other terminal connected with an output terminal of the second operational amplifier.

6. A display device, comprising a display panel driving circuit, wherein the display panel comprises a plurality of pixel units defined by intersected gate lines and data lines and arranged in a matrix form, and the display device driving circuit comprises pixel charging units, each of which is used for combining a voltage outputted from a clock pulse vertical terminal and a voltage outputted from a data voltage signal terminal to serve as a driving voltage for a data line;

wherein each of the pixel charging units comprises:

a pixel charging switch with a first electrode connected with the clock pulse vertical terminal and a gate connected with the data voltage signal terminal; and an adder with an input terminal connected with the data voltage signal terminal and a second electrode of the pixel charging switch respectively, and an output terminal connected with the data line.

7. The display device according to claim 6, wherein each of the data lines is connected with one pixel charging unit.

8. The display device according to claim 6, wherein the adder comprises:

a first operational amplifier with a grounded non-inverting input terminal;

a first resistor with one terminal connected with the second electrode of the pixel charging switch and the other terminal connected with an inverting input terminal of the first operational amplifier;

a second resistor with one terminal connected with the data voltage signal terminal and the other terminal connected with the inverting input terminal of the first operational amplifier; and a third resistor with one terminal connected with the data voltage signal terminal and the other terminal connected with an output terminal of the first operational amplifier.

9. The display device according to claim 8, wherein when the adder is an inverting adder, the pixel charging unit further comprises:

an inverter, which is connected between the adder and the data line to change a polarity of a voltage signal output by the adder.

10. The display device according to claim 9, wherein the inverter comprises:

a second operational amplifier with a grounded non-inverting input terminal;

a fourth resistor with one terminal connected with the output terminal of the first operational amplifier and the other terminal connected with an inverting input terminal of the second operational amplifier; and a fifth resistor with one terminal connected with the inverting input terminal of the second operational amplifier and the other terminal connected with an output terminal of the second operational amplifier.

11. A driving method of a display panel driving circuit, wherein the display panel comprises a plurality of pixel units defined by intersected gate lines and data lines and arranged in a matrix form, and the drive method comprises steps of:

inputting voltage signals outputted from a clock pulse vertical terminal and a data voltage signal terminal to a pixel charging unit;

combining, by the pixel charging unit, voltages outputted from the clock pulse vertical terminal and the data voltage signal terminal to serve as a driving voltage for a data line; and combining the voltages outputted from the clock pulse vertical terminal and the data voltage signal terminal by an adder to serve as the driving voltage for the data line when a pixel charging switch is turned on.

12. The driving method according to claim 11, wherein when the adder is an inverting adder, the driving method further comprises a step of:

changing, by an inverter, a polarity of a voltage signal outputted by the adder.

* * * * *